US008177395B2

(12) United States Patent
Alexander et al.

(10) Patent No.: US 8,177,395 B2
(45) **Date of Patent: *May 15, 2012**

(54) LIGHTING ASSEMBLY AND LIGHT MODULE FOR SAME

(75) Inventors: Clayton Alexander, Westlake Village, CA (US); Brandon S. Mundell, Thousand Oaks, CA (US)

(73) Assignee: Journée Lighting, Inc., Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/175,376

(22) Filed: Jul. 1, 2011

(65) Prior Publication Data

US 2012/0002445 A1 Jan. 5, 2012

Related U.S. Application Data

(63) Continuation of application No. 12/986,934, filed on Jan. 7, 2011, now Pat. No. 7,972,054, which is a continuation of application No. 12/149,900, filed on May 9, 2008, now Pat. No. 7,866,850.

(60) Provisional application No. 61/064,282, filed on Feb. 26, 2008.

(51) Int. Cl.
*F21V 29/00* (2006.01)

(52) U.S. Cl. ..... 362/294; 362/652; 362/147; 439/427

(58) Field of Classification Search ..... 362/147, 362/148, 640, 652, 800, 294, 373; 439/427, 439/76.1; 313/317, 318.01, 318.12
See application file for complete search history.

(56) References Cited

U.S. PATENT DOCUMENTS

| | | | |
|---|---|---|---|
| 2,430,472 | A | 11/1947 | Levy |
| D149,124 | S | 3/1948 | Hewitt |
| D152,113 | S | 12/1948 | Mehr |
| D191,734 | S | 11/1961 | Daher et al. |
| D217,096 | S | 4/1970 | Birns |

(Continued)

FOREIGN PATENT DOCUMENTS

JP 2004/265626 A 9/2004

(Continued)

OTHER PUBLICATIONS

International Search Report and Written Opinion as mailed on Jan. 19, 2010, received in PCT Application PCT/US09/64858.

(Continued)

*Primary Examiner* — Ali Alavi
(74) *Attorney, Agent, or Firm* — Knobbe Martens Olson & Bear, LLP

(57) ABSTRACT

A lighting assembly that has a light fixture and an LED light module is provided. One or more resilient members generate a compression force when the LED light module is removably coupled to the light fixture to thereby exert a generally axial force on the LED light module to resiliently maintain the LED light module in resilient contact with the light fixture or socket of the light fixture to thereby resiliently couple the LED light module to the light fixture or socket of the light fixture. One or both of the LED light module and light fixture have one or more engaging members that extend radially from a circumferential surface thereof, and one or both of the LED light module and the light fixture have one or more slots configured to removably receive the one or more engaging members therein when coupling the LED light module to the light fixture.

16 Claims, 14 Drawing Sheets

U.S. PATENT DOCUMENTS

| | | | |
|---|---|---|---|
| 3,538,321 | A | 11/1970 | Keller et al. |
| 3,639,751 | A | 2/1972 | Pichel |
| 4,091,444 | A | 5/1978 | Mori |
| 4,453,203 | A | 6/1984 | Pate |
| 4,578,742 | A | 3/1986 | Klein et al. |
| 4,733,335 | A | 3/1988 | Serizawa et al. |
| 4,761,721 | A | 8/1988 | Willing |
| 4,872,097 | A | 10/1989 | Miller |
| D322,862 | S | 12/1991 | Miller |
| D340,514 | S | 10/1993 | Liao |
| 5,303,124 | A | 4/1994 | Wrobel |
| 5,337,225 | A | 8/1994 | Brookman |
| 5,634,822 | A | 6/1997 | Gunell |
| D383,236 | S | 9/1997 | Krogman |
| 5,909,955 | A | 6/1999 | Roorda |
| 6,072,160 | A | 6/2000 | Bahl |
| D437,449 | S | 2/2001 | Soller |
| D437,652 | S | 2/2001 | Uhler et al. |
| D443,710 | S | 6/2001 | Chiu |
| D446,592 | S | 8/2001 | Leen |
| D448,508 | S | 9/2001 | Benghozi |
| D457,673 | S | 5/2002 | Martinson et al. |
| 6,441,943 | B1 | 8/2002 | Roberts et al. |
| D462,801 | S | 9/2002 | Huang |
| D464,455 | S | 10/2002 | Fong et al. |
| D465,046 | S | 10/2002 | Layne et al. |
| 6,478,453 | B2 | 11/2002 | Lammers et al. |
| D470,962 | S | 2/2003 | Chen |
| D476,439 | S | 6/2003 | O'Rourke |
| 6,632,006 | B1 | 10/2003 | Rippel et al. |
| D482,476 | S | 11/2003 | Kwong |
| 6,682,211 | B2 | 1/2004 | English et al. |
| 6,703,640 | B1 | 3/2004 | Hembree et al. |
| 6,744,693 | B2 | 6/2004 | Brockmann et al. |
| 6,787,999 | B2 | 9/2004 | Stimac et al. |
| 6,824,390 | B2 | 11/2004 | Brown et al. |
| 6,864,513 | B2 | 3/2005 | Lin et al. |
| 6,871,993 | B2 | 3/2005 | Hecht |
| D504,967 | S | 5/2005 | Kung |
| 6,902,291 | B2 | 6/2005 | Rizkin et al. |
| 6,905,232 | B2 | 6/2005 | Lin |
| 6,966,677 | B2 | 11/2005 | Galli |
| D516,229 | S | 2/2006 | Tang |
| D524,975 | S | 7/2006 | Oas |
| D527,119 | S | 8/2006 | Maxik et al. |
| 7,097,332 | B2 | 8/2006 | Vamberi |
| 7,111,963 | B2 | 9/2006 | Zhang |
| 7,111,971 | B2 | 9/2006 | Coushaine et al. |
| 7,132,804 | B2 | 11/2006 | Lys et al. |
| 7,150,553 | B2 | 12/2006 | English et al. |
| 7,198,386 | B2 | 4/2007 | Zampini et al. |
| 7,207,696 | B1 | 4/2007 | Lin |
| D541,957 | S | 5/2007 | Wang |
| D544,110 | S | 6/2007 | Hooker et al. |
| D545,457 | S | 6/2007 | Chen |
| D564,119 | S | 3/2008 | Metlen |
| 7,344,279 | B2 | 3/2008 | Mueller et al. |
| 7,344,296 | B2 | 3/2008 | Matsui et al. |
| 7,357,534 | B2 | 4/2008 | Snyder |
| 7,396,139 | B2 | 7/2008 | Savage |
| 7,396,146 | B2 | 7/2008 | Wang |
| 7,413,326 | B2 | 8/2008 | Tain et al. |
| D577,453 | S | 9/2008 | Metlen |
| 7,452,115 | B2 | 11/2008 | Alcelik |
| D585,588 | S | 1/2009 | Alexander et al. |
| D585,589 | S | 1/2009 | Alexander et al. |
| 7,494,248 | B2 | 2/2009 | Li |
| 7,540,761 | B2 * | 6/2009 | Weber et al. ..... 439/487 |
| 7,722,227 | B2 | 5/2010 | Zhang et al. |
| 7,740,380 | B2 | 6/2010 | Thrailkill |
| 7,744,266 | B2 | 6/2010 | Higley et al. |
| D626,094 | S | 10/2010 | Alexander et al. |
| 7,866,850 | B2 | 1/2011 | Alexander et al. |
| 7,874,700 | B2 | 1/2011 | Patrick |
| 7,972,054 | B2 * | 7/2011 | Alexander et al. ..... 362/652 |
| 7,985,005 | B2 | 7/2011 | Alexander et al. |
| 2002/0067613 | A1 | 6/2002 | Grove |
| 2003/0185005 | A1 | 10/2003 | Sommers et al. |
| 2004/0212991 | A1 | 10/2004 | Galli |
| 2005/0047170 | A1 | 3/2005 | Hilburger et al. |
| 2005/0122713 | A1 | 6/2005 | Hutchins |
| 2005/0146884 | A1 | 7/2005 | Scheithauer |
| 2005/0174780 | A1 | 8/2005 | Park |
| 2006/0076672 | A1 | 4/2006 | Petroski |
| 2006/0146531 | A1 | 7/2006 | Reo et al. |
| 2006/0262544 | A1 | 11/2006 | Piepgras et al. |
| 2006/0262545 | A1 | 11/2006 | Piepgras et al. |
| 2007/0025103 | A1 | 2/2007 | Chan |
| 2007/0109795 | A1 | 5/2007 | Gabrius et al. |
| 2007/0242461 | A1 | 10/2007 | Reisenauer et al. |
| 2007/0253202 | A1 | 11/2007 | Wu et al. |
| 2007/0297177 | A1 | 12/2007 | Wang et al. |
| 2008/0013316 | A1 | 1/2008 | Chiang |
| 2008/0080190 | A1 | 4/2008 | Walczak et al. |
| 2008/0084700 | A1 | 4/2008 | Van De Ven |
| 2008/0106907 | A1 | 5/2008 | Trott et al. |
| 2008/0130275 | A1 | 6/2008 | Higley et al. |
| 2008/0158887 | A1 | 7/2008 | Zhu et al. |
| 2009/0086474 | A1 | 4/2009 | Chou |
| 2009/0154166 | A1 | 6/2009 | Zhang et al. |
| 2010/0026158 | A1 | 2/2010 | Wu |
| 2010/0027258 | A1 | 2/2010 | Maxik et al. |
| 2010/0091487 | A1 | 4/2010 | Shin |
| 2010/0091497 | A1 | 4/2010 | Chen et al. |
| 2010/0102696 | A1 | 4/2010 | Sun |
| 2010/0127637 | A1 | 5/2010 | Alexander et al. |
| 2011/0063849 | A1 | 3/2011 | Alexander et al. |

FOREIGN PATENT DOCUMENTS

| | | | |
|---|---|---|---|
| JP | 2007/273209 | A | 10/2007 |
| WO | WO DM/57383 | | 9/2001 |
| WO | WO 2004/071143 | | 8/2004 |
| WO | WO 2007/128070 | A1 | 11/2007 |
| WO | WO 2008/108832 | | 9/2008 |

OTHER PUBLICATIONS

International Search Report and Written Opinion mailed on Oct. 14, 2010 in PCT Application No. PCT/US2010/045361.

PCT International Search Report and the Written Opinion mailed Jun. 23, 2008, in related PCT Application No. PCT/US2007/023110.

PCT International Search Report and the Written Opinion mailed Jun. 25, 2009, in related PCT Application No. PCT/US2009/035321.

Non-final Office Action mailed on Sep. 19, 2011 in U.S. Appl. No. 12/409,409.

* cited by examiner

LIGHTING ASSEMBLY AND LIGHT MODULE FOR SAME

PRIOR APPLICATION

This application is a continuation application of U.S. application Ser. No. 12/986,934, filed Jan. 7, 2011, now U.S. Pat. No. 7,972,054, which is a continuation application of U.S. application Ser. No. 12/149,900, filed May 9, 2008, now U.S. Pat. No. 7,866,850, which claims the benefit of priority to U.S. Provisional Patent Application No. 61/064,282, filed Feb. 26, 2008, the entire contents of all of which are hereby incorporated by reference in their entirety.

BRIEF DESCRIPTION

1. Technical Field

The present invention is directed to an LED assembly that can be connected thermally and/or electrically to a light fixture assembly housing.

2. Background

Light fixture assemblies such as lamps, ceiling lights, and track lights are important fixtures in many homes and places of business. Such assemblies are used not only to illuminate an area, but often also to serve as a part of the decor of the area. However, it is often difficult to combine both form and function into a light fixture assembly without compromising one or the other.

Traditional light fixture assemblies typically use incandescent bulbs. Incandescent bulbs, while inexpensive, are not energy efficient, and have a poor luminous efficiency. To address the shortcomings of incandescent bulbs, a move is being made to use more energy-efficient and longer lasting sources of illumination, such as fluorescent bulbs, high-intensity discharge (HID) bulbs, and light emitting diodes (LEDs). Fluorescent bulbs and HID bulbs require a ballast to regulate the flow of power through the bulb, and thus can be difficult to incorporate into a standard light fixture assembly. Accordingly, LEDs, formerly reserved for special applications, are increasingly being considered as a light source for more conventional light fixture assemblies.

LEDs offer a number of advantages over incandescent, fluorescent, and HID bulbs. For example, LEDs produce more light per watt than incandescent bulbs, LEDs do not change their color of illumination when dimmed, and LEDs can be constructed inside solid cases to provide increased protection and durability. LEDs also have an extremely long life span when conservatively run, sometimes over 100,000 hours, which is twice as long as the best fluorescent and HID bulbs and twenty times longer than the best incandescent bulbs. Moreover, LEDs generally fail by a gradual dimming over time, rather than abruptly burning out, as do incandescent, fluorescent, and HID bulbs. LEDs are also desirable over fluorescent bulbs due to their decreased size and lack of need of a ballast, and can be mass produced to be very small and easily mounted onto printed circuit boards.

While LEDs have various advantages over incandescent, fluorescent, and HID bulbs, the widespread adoption of LEDs has been hindered by the challenge of how to properly manage and disperse the heat that LEDs emit. The performance of an LED often depends on the ambient temperature of the operating environment, such that operating an LED in an environment having a moderately high ambient temperature can result in overheating the LED, and premature failure of the LED. Moreover, operation of an LED for extended period of time at an intensity sufficient to fully illuminate an area may also cause an LED to overheat and prematurely fail.

Accordingly, high-output LEDs require direct thermal coupling to a heat sink device in order to achieve the advertised life expectancies from LED manufacturers. This often results in the creation of a light fixture assembly that is not upgradeable or replaceable within a given light fixture. For example, LEDs are traditionally permanently coupled to a heat-dissipating fixture housing, requiring the end-user to discard the entire assembly after the end of the LED's lifespan. As a solution, exemplary embodiments of a light fixture assembly may transfer heat from the LED directly into the light fixture housing through a compression-loaded member, such as a thermal pad, to allow for proper thermal conduction between the two. Additionally, exemplary embodiments of the light fixture assembly may allow end-users to upgrade their LED engine as LED technology advances by providing a removable LED light source with thermal coupling without the need for expensive metal springs during manufacture, or without requiring the use of excessive force by the LED end-user to install the LED in the light fixture housing.

Exemplary embodiments of a light fixture assembly may include (1) an LED assembly and (2) an LED socket. The LED assembly may contain a first engagement member, and the socket may contain a second engagement member, such as angled slots. When the LED assembly is rotated, the first engagement member may move down the angled slots such that a compression-loaded thermal pad forms an interface with a light fixture housing. This compressed interface may allow for proper thermal conduction from the LED assembly into the light fixture housing. Additionally, as the LED assembly rotates into an engagement position, it connects with the LED socket's electrical contacts for electricity transmission. Thus, the use of the compressed interface may increase the ease of operation, and at the same time allow for a significant amount of compression force without the need of conventional steel springs. Further, the LED assembly and LED socket can be used in a variety of heat dissipating fixture housings, allowing for easy removal and replacement of the LED. While in some embodiments the LED assembly and LED socket are shown as having a circular perimeter, various shapes may be used for the LED assembly and/or the LED socket.

SUMMARY

Consistent with the present invention, there is provided a thermally-conductive housing; a removable LED assembly, the LED assembly comprising an LED lighting element; and a compression element, operation of the compression element from a first position to a second position generating a compression force causing the LED assembly to become thermally and electrically connected to the housing.

Consistent with the present invention, there is provided an LED assembly for a light fixture assembly, the light fixture assembly having a thermally-conductive housing, a socket attached to the housing, and a first engaging member, the LED assembly comprising: an LED lighting element; a resilient member; and a second engaging member adapted to engage with the first engaging member; operation of the LED assembly and the socket relative to each other from an alignment position to an engaged position causing the first engaging member to engage the second engaging member and the resilient member to create a compression force to reduce thermal impedance between the LED assembly and the housing.

Consistent with the present invention, there is provided a method of manufacturing a light fixture assembly, the method comprising forming an LED assembly including an LED lighting element and a first engaging member; forming a socket attached to a thermally-conductive housing, the socket comprising a second engaging member adapted to engage with the first engaging member; and moving the LED assembly and the socket relative to each other from an alignment position to an engaged position, to cause the first engaging member to engage with the second engaging member and create a compression force establishing an electrical contact and a thermal contact between the LED assembly and a fixture housing.

Consistent with the present invention, there is provided a light fixture assembly comprising a thermally-conductive housing; a socket attached to the housing and comprising a first engaging member; and an LED assembly, comprising: an LED lighting element; a resilient member; and a second engaging member adapted to engage with the first engaging member; the LED assembly and the socket being movable relative to each other from an alignment position to an engaged position; the first engaging member, in the engaged position, engaging the second engaging member and fixedly positioning the LED assembly relative to the socket; and the resilient member, in the engaged position, creating a compression force forming an electrical contact and a thermal contact between the LED assembly and the housing.

In accordance with one embodiment, a lighting assembly is provided comprising a light fixture and a light module comprising an LED lighting element and removably coupleable to the light fixture. The lighting assembly also comprises one or more resilient members configured to generate a compression force when the light module is removably coupled to the light fixture to thereby exert a generally axial force on at least a portion of the light module to resiliently maintain at least a portion of the light module in resilient contact with a surface of the light fixture or socket of the light fixture to thereby resiliently couple at least a portion of the light module to the light fixture or socket of the light fixture. One or both of the light module and light fixture comprises one or more engaging members that extend from a surface thereof, and one or both of the light module and the light fixture comprises one or more slots configured to removably receive the one or more engaging members therein when coupling the light module to the light fixture.

In accordance with another embodiment, a light module removably coupleable to a light fixture is provided. The light module comprises a generally cylindrical housing and an LED lighting element at least partially disposed in the housing. The light module also comprises one or more electrical contact members configured to releasably contact one or more electrical contacts of a socket of a light fixture to provide an operative electrical connection between the light module and the socket of the light fixture when the light module is coupled to the light fixture. The light module also comprises one or more engaging members on the housing, the engaging members configured to releasably engage corresponding one or more engaging elements in the socket of the light fixture when coupling the light module to the socket. The engagement of the engaging members with the engaging elements of the socket axially drives at least a portion of the light module into resilient contact with a surface of a light fixture or socket of the light fixture when coupling the light module to the socket to thereby thermally couple the light module to the light fixture or socket of the light fixture.

In accordance with yet another embodiment, a method for coupling a light module to a light fixture is provided. The method comprises aligning one or more tabs in one or both of the light module and a socket of the light fixture with one or more slots in one or both of the light module and the socket of the light fixture. The method also comprises axially introducing at least a portion of the light module into a cylindrical recess of the socket such that the one or more tabs axially advance into at least a portion of the one or more slots. The method also comprises rotating the light module relative to the socket such that the one or more tabs movably engage an inclined portion of the one or more slots, the inclined portion of the one or more slots being inclined such that at least a portion of the light module moves axially toward a bottom of the socket as the light module is rotated relative to the socket. The method also comprises generating a compression force as the light module is rotated relative to the socket to thereby exert a generally axial force on at least a portion of the light module to resiliently maintain at least a portion of the light module into resilient contact with the light fixture or socket of the light fixture.

In accordance with still another embodiment, a lighting assembly is provided comprising a heat dissipating member comprising a socket having a first threaded portion. The lighting assembly also comprises an LED module comprising an LED lighting element and a second threaded portion. The LED module and the socket are rotationally movable relative to each other from a disengaged position to an engaged position to couple the first and second threaded portions which establishes a thermal path from the LED module to the heat dissipating member or socket of the heat dissipating member. A compression element in one or both of the socket and the LED module and/or the threaded portions is configured to maintain a compression force between the LED module and the socket when coupling the LED module to the socket.

In accordance with yet another embodiment, a removable LED module for use with a lighting assembly is provided. The LED module comprises and LED lighting element and one or more electrical contact members of the LED module configured to releasably contact one or more electrical contacts of a socket of the lighting assembly when coupling the LED module to the socket. The LED module further comprises one or more resilient members configured to move from a first position to a second position when coupling the LED module to the socket to generate a compression force to thereby exert a generally axial force on at least a portion of the light module to resiliently maintain at least a portion of the light module in resilient contact with the light fixture or socket of the light fixture to thereby thermally couple at least a portion of the light module to the light fixture or socket of the light fixture.

It is to be understood that both the foregoing general description and the following detailed description are exemplary and explanatory only and are not restrictive of the invention, as claimed.

The accompanying drawings, which are incorporated in and constitute a part of this specification, illustrate embodiments consistent with the invention and together with the description, serve to explain the principles of the invention.

DETAILED DESCRIPTION

Reference will now be made in detail to the exemplary embodiments consistent with the present invention, an example of which is illustrated in the accompanying drawings. Wherever possible, the same reference numbers will be used throughout the drawings to refer to the same or like parts. It is apparent, however, that the embodiments shown in the accompanying drawings are not limiting, and that modifications may be made without departing from the spirit and scope of the invention.

Figure 1:
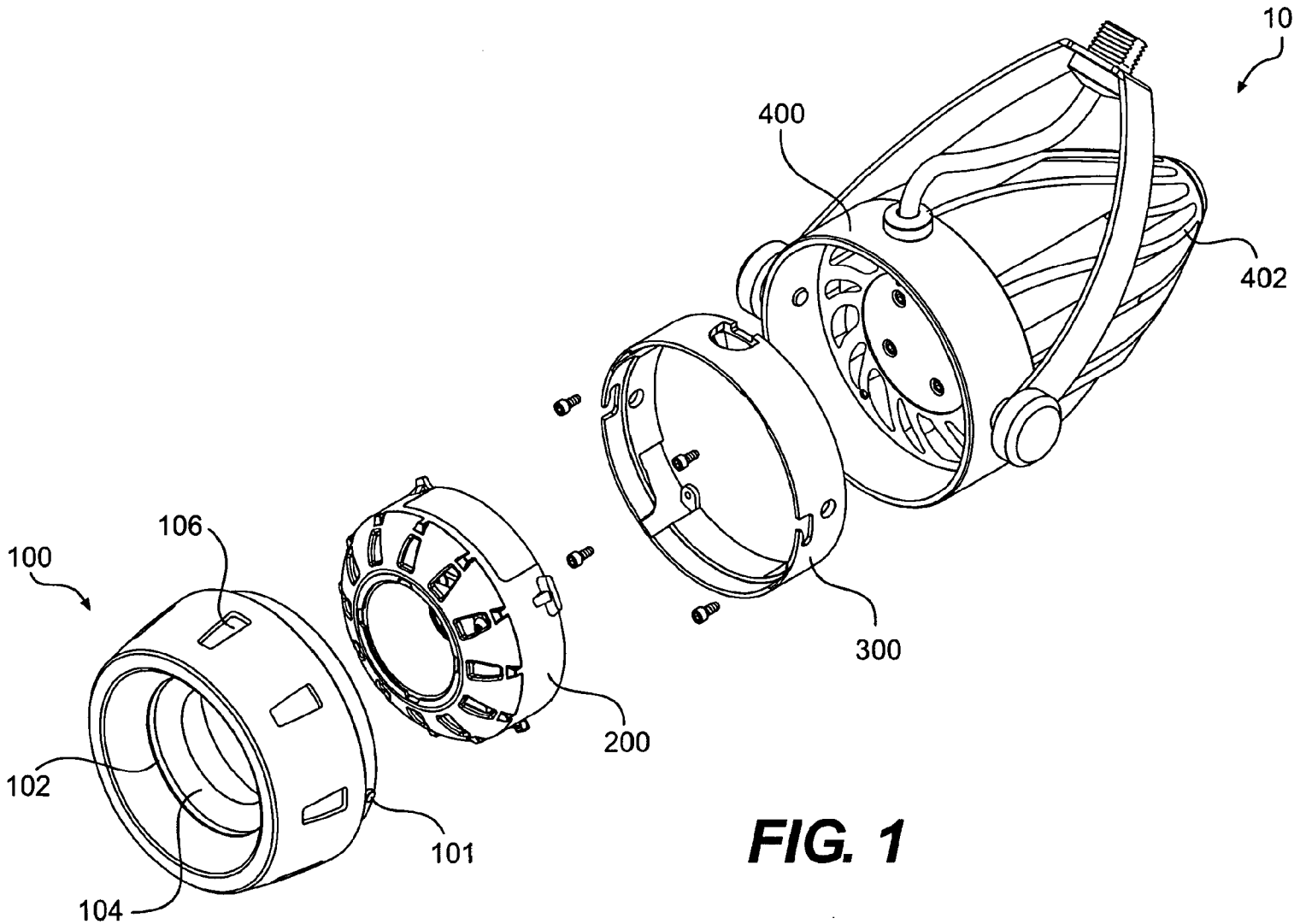
FIG. 1 is an exploded perspective view of a light fixture assembly consistent with the present invention.

FIG. 1 is an exploded perspective view of a light fixture assembly 10 consistent with the present invention. Light fixture assembly 10 includes a front cover 100, a LED assembly 200, a socket 300, and a thermally-conductive housing 400.

Figure 2:
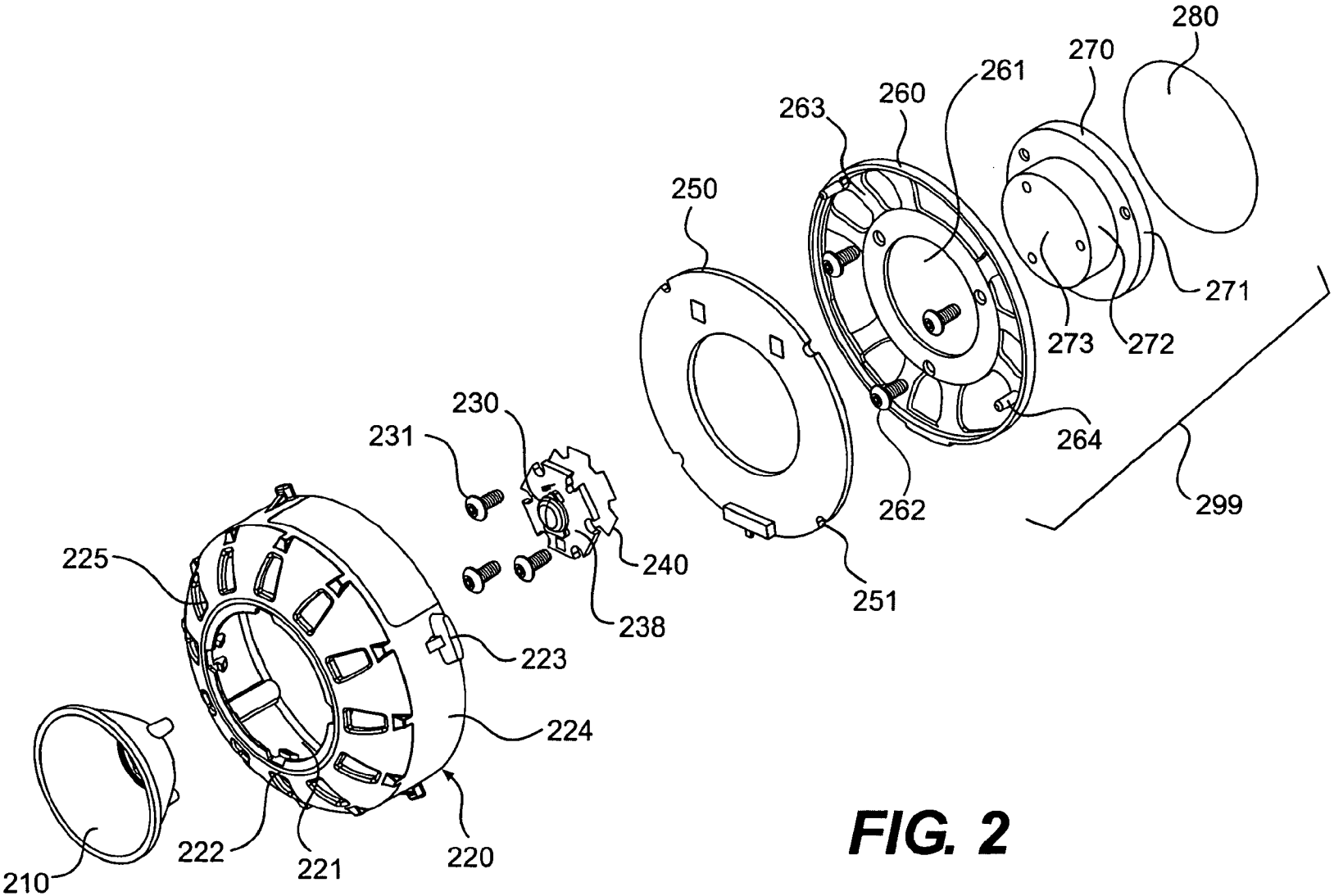
FIG. 2 is an exploded perspective view of an LED assembly of the light fixture assembly of FIG. 1.

FIG. 2 is an exploded perspective view of LED assembly 200. LED assembly 200 may include a reflector, or optic, 210; a first shell 220; a lighting element, such as an LED 230; a thermally conductive material 240; a printed circuit board 250; a second shell 260; a thermal interface member 270; and a thermal pad 280.

First shell 220 may include an opening 221 adapted to receive optic 210, which may be fixed to first shell 220 through an optic-attaching member 222. First shell 220 may also include one or more airflow apertures 225 so that air may pass through airflow apertures 225 and ventilate printed circuit board 250, LED 230, and thermally-conductive housing 400. First shell 220 may also include one or more engaging members 223, such as protrusions, on its outer surface 224. While in this exemplary embodiment engaging members 223 are shown as being "T-shaped" tabs, engaging members 223 can have a variety of shapes and can be located at various positions and/or on various surfaces of LED assembly 200. Furthermore, the number of engaging members 223 is not limited to the embodiment shown in FIG. 2. Additionally, the number, shape and/or location of airflow apertures 225 can also be varied. However, in certain applications, ventilation may not be required, and airflow apertures 225 may thus be omitted.

Second shell 260 may include a resilient member, such as resilient ribs 263. The thickness and width of ribs 263 can be adjusted to increase or decrease compression force, and the openings between ribs 263 can vary in size and/or shape. Ribs 263 in second shell 260 are formed so as to provide proper resistance to create compression for thermal coupling of LED assembly 200 to thermally-conductive housing 400. Second shell 260 may also include one or more positioning elements 264 that engage with one or more recesses 251 in printed circuit board 250 to properly position printed circuit board 250 and to hold printed circuit board 250 captive between first shell 220 and second shell 260. Positioning elements 264 may also engage with receivers (not shown) in first shell 220. First and second shells 220 and 260 may be made of a plastic or resin material such as, for example, polybutylene terephthalate.

Figure 3:
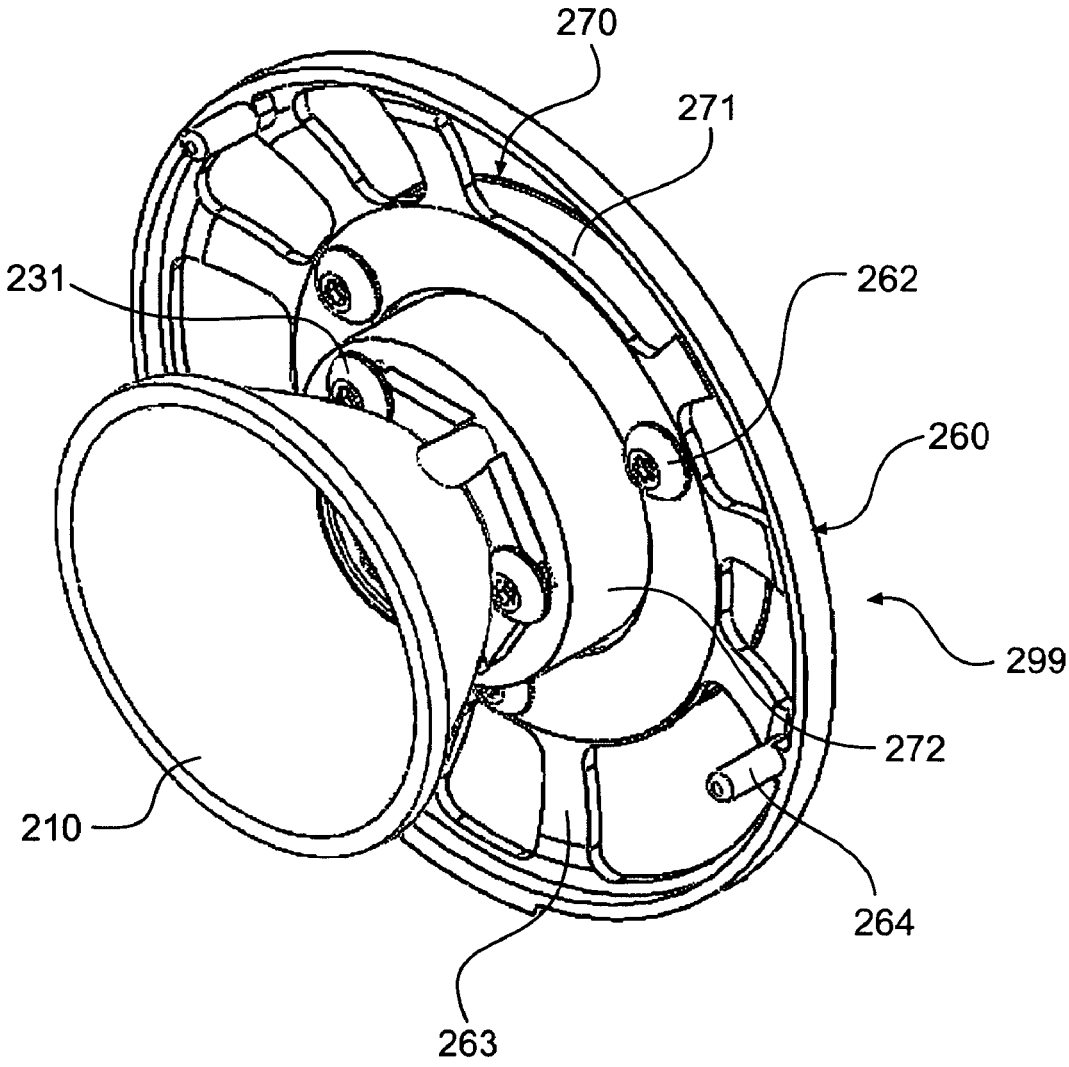
FIG. 3 is a detailed perspective view of the second shell of the LED assembly of FIG. 2.

As shown in FIG. 2, the second shell 260 may also include an opening 261 adapted to receive thermal interface member 270, which may be fixed to (1) second shell 260 through one or more attachment members 262, such as screws or other known fasteners and (2) a thermal pad 280 to create thermal interface member assembly 299. Thermal interface member 270 may include an upper portion 271, and a lower portion 272 with a circumference smaller than the circumference of upper portion 271. As shown in FIG. 3, lower portion 272 may be inserted through opening 261 of second shell 260 such that upper portion 271 engages with second shell 260. Second shell 260 may be formed of, for example, nylon and/or thermally conductive plastics such as plastics made by Cool Polymers, Inc., known as CoolPoly®.

Referring now to FIG. 2, thermal pad 280 may be attached to thermal interface member 270 through an adhesive or any other appropriate known fastener so as to fill microscopic gaps and/or pores between the surface of the thermal interface member 270 and thermally-conductive housing 400. Thermal pad 280 may be any of a variety of types of commercially available thermally conductive pad, such as, for example, Q-PAD 3 Adhesive Back, manufactured by The Bergquist Company. While thermal pad 280 is used in this embodiment, it can be omitted in some embodiments.

As shown in FIG. 2, lower portion 272 of thermal interface member 270 may serve to position LED 230 in LED assembly 200. LED 230 may be mounted to a surface 273 of lower portion 272 using fasteners 231, which may be screws or other well-known fasteners. A thermally conductive material 240 may be positioned between LED 230 and surface 273.

The machining of both the bottom surface of LED 230 and surface 273 during the manufacturing process may leave minor imperfections in these surfaces, forming voids. These voids may be microscopic in size, but may act as an impedance to thermal conduction between the bottom surface of LED 230 and surface 273 of thermal interface 270. Thermally conductive material 240 may act to fill in these voids to reduce the thermal impedance between LED 230 and surface 273, resulting in improved thermal conduction. Moreover, consistent with the present invention, thermally conductive material 240 may be a phase-change material which changes from a solid to a liquid at a predetermined temperature, thereby improving the gap-filling characteristics of the thermally conductive material 240. For example, thermally conductive material 240 may include a phase-change material such as, for example, Hi-Flow 225UT 003-01, manufactured by The Bergquist Company, which is designed to change from a solid to a liquid at 55° C.

While in this embodiment thermal interface member 270 may be made of aluminum and is shown as resembling a "top hat," various other shapes, sizes, and/or materials could be used for the thermal interface member to transport and/or spread heat. As one example, thermal interface member 270 could resemble a "pancake" shape and have a single circumference. Furthermore, thermal interface member 270 need not serve to position the LED 230 within LED assembly 200. Additionally, while LED 230 is shown as being mounted to a substrate 238, LED 230 need not be mounted to substrate 238 and may instead be directly mounted to thermal interface member 270. LED 230 may be any appropriate commercially available single- or multiple-LED chip, such as, for example, an OSTAR 6-LED chip manufactured by OS RAM GmbH, having an output of 400-650 lumens.

Figure 4:
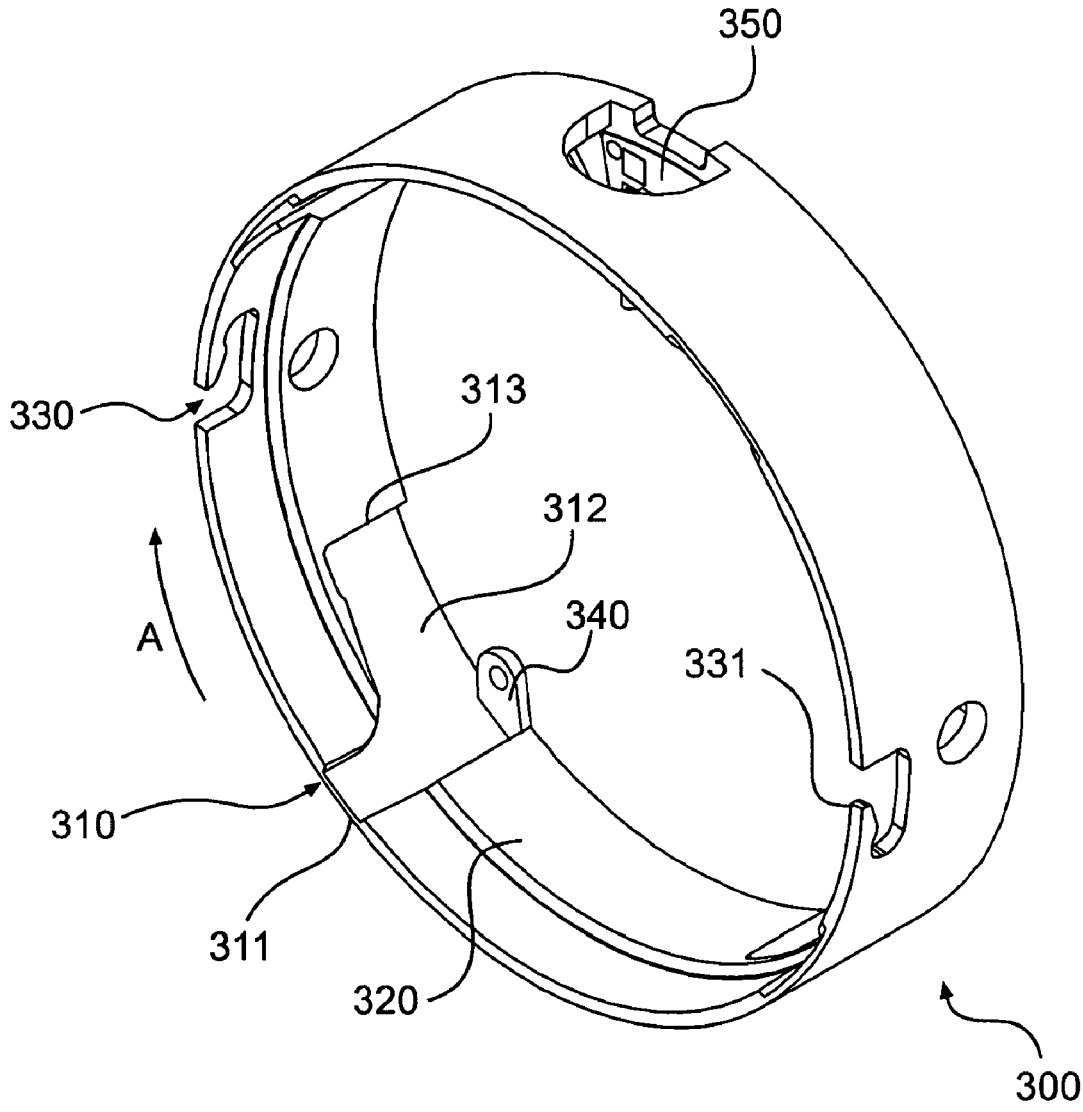
FIG. 4 is a perspective view of a socket of the light fixture assembly of FIG. 1.
Figure 7:
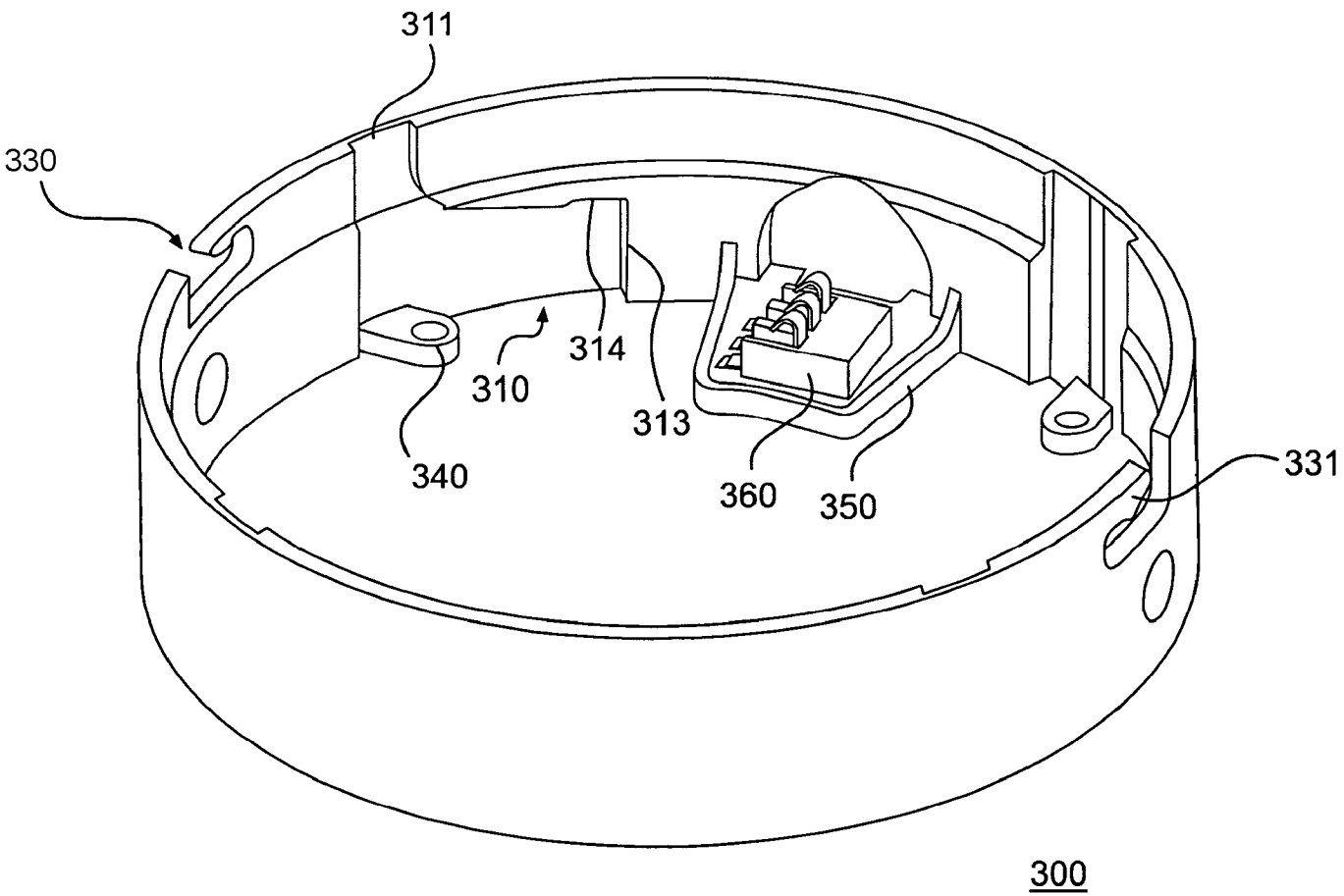
FIG. 7 is a perspective view of the LED socket of FIG. 4.
Figure 10:
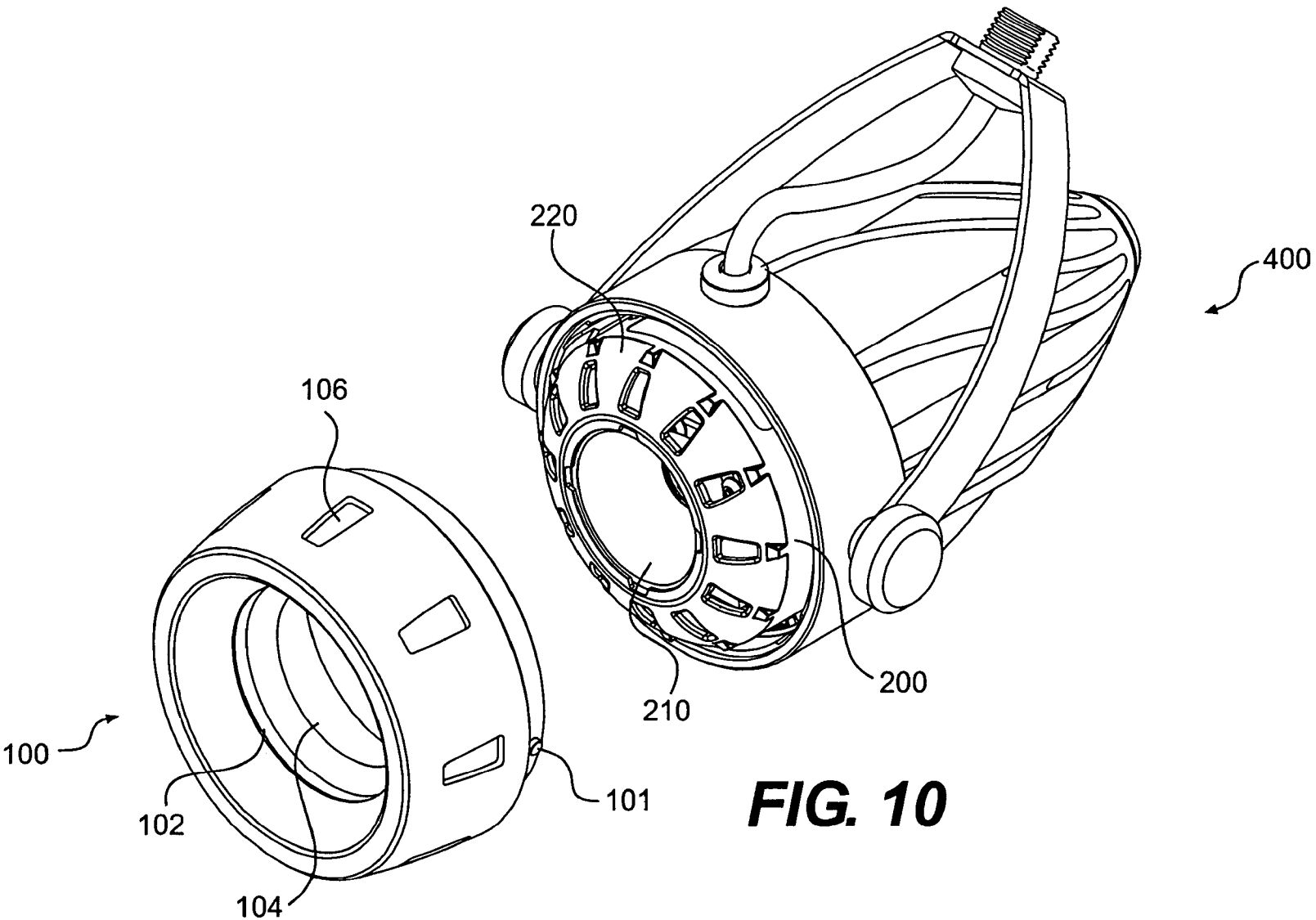
FIG. 10 is a perspective view of the light fixture assembly of FIG. 1.

FIG. 4 is a perspective view of socket 300 including one or more engaging members, such as angled slot 310 arranged on inner surface 320 of LED socket 300. Slot 310 includes a receiving portions 311 that receives and is engageable with a respective engaging member 223 of first shell 220 at an alignment position, a lower portion 312 that extends circumferentially around a portion of the perimeter of LED socket 300 and is adapted to secure LED assembly 200 to LED socket 300, and a stopping portion 313. In some embodiments, stopping portion 313 may include a protrusion (not shown) that is also adapted to secure LED assembly 200 to LED socket 300. Slot 310 may include a slight recess 314, serving as a locking mechanism for engaging member 223. Socket 300 also includes a front cover retaining mechanism 330 adapted to engage with a front cover engaging member 101 in front cover 100 (shown in FIGS. 1 and 10). A front cover retaining mechanism lock 331 (FIG. 5) is provided such that when front cover retaining mechanism 330 engages with and is rotated with respect to front cover engaging member 101, the front cover retaining mechanism lock holds the front cover 100 in place. Socket 300 may be fastened to thermally-conductive housing 400 through a retaining member, such as retaining member 340 using a variety of well-known fasteners, such as screws and the like. Socket 300 could also have a threaded outer surface that engages with threads in thermally-conductive housing 400. Alternatively, socket 300 need not be a separate element attached to thermally-conductive housing 400, but could be integrally formed in thermally-conductive housing 400 itself. Additionally, as shown in FIG. 7, socket 300 may also include a tray 350 which holds a terminal block 360, such as a battery terminal connector.

Figure 5:
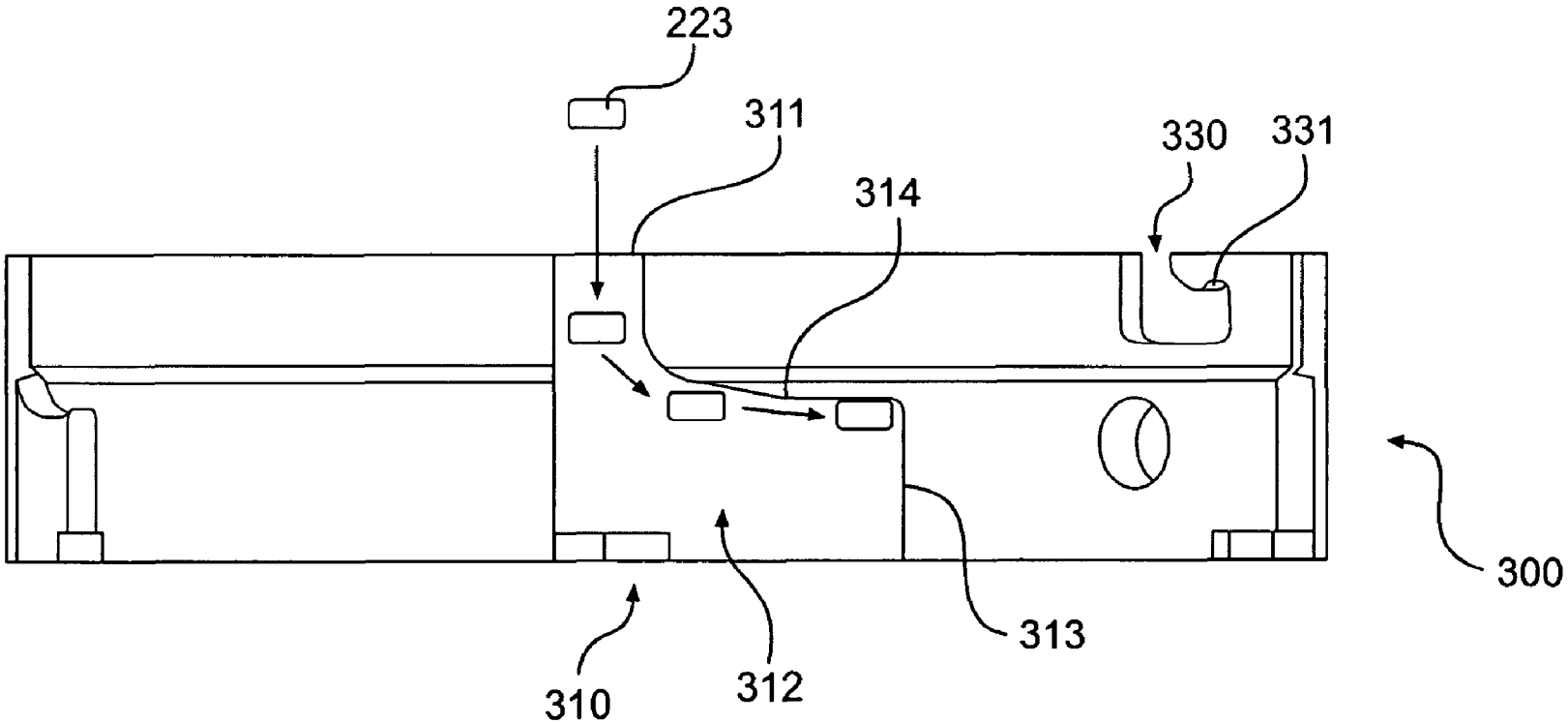
FIG. 5 is a side view of the socket showing the travel of an engaging member of the LED assembly of FIG. 2.

Referring now to FIG. 5, to mount LED assembly 200 in socket 300, LED assembly 200 is placed in an alignment position, in which engaging members 223 of LED assembly 200 are aligned with receiving portions 311 of angled slots 310 of socket 300. In one embodiment, LED assembly 200 and socket 300 may have a circular perimeter and, as such, LED assembly 200 may be rotated with respect to socket 300 in the direction of arrow A in FIG. 4. As shown in FIG. 5, when LED assembly 200 is rotated, engaging members 223 travel down receiving portions 311 into lower portions 312 of angled slots 310 until engaging members 223 meet stopping portion 313, which limits further rotation and/or compression of LED assembly 200, thereby placing LED assembly 200 and socket 300 in an engagement position.

Figure 6A:
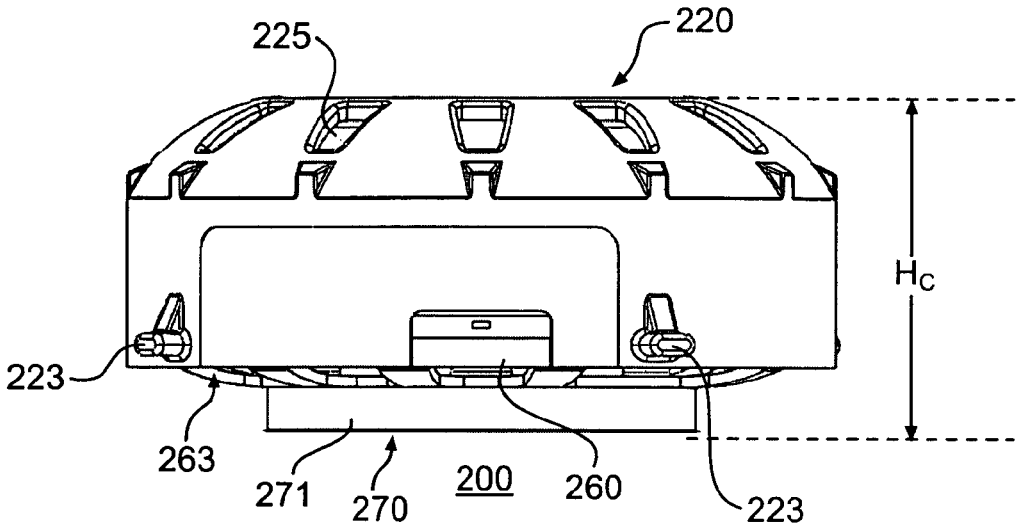
FIG. 6A is a side view of the LED assembly of FIG. 2 in a compressed state.
Figure 6B:
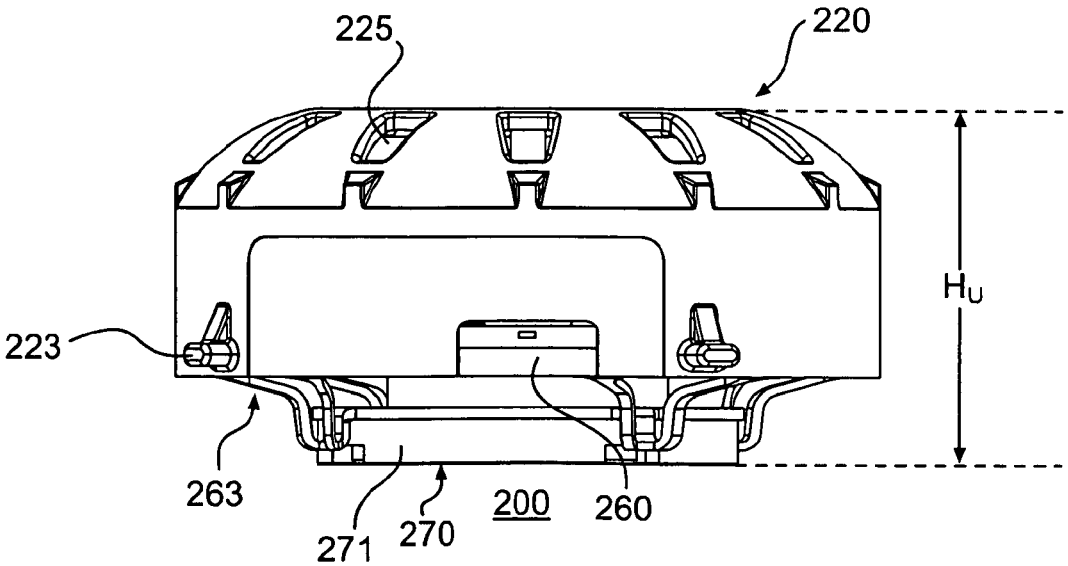
FIG. 6B is a side view of the LED assembly of FIG. 2 in an uncompressed state.

Referring now to FIGS. 6A and 6B, second shell 260 is shown in compressed and uncompressed states, respectively. The rotation of LED assembly 200, and the pressing of engaging members 223 on upper surface 314 of angled slots 310 causes resilient ribs 263 of second shell 260 to deform axially inwardly which may decrease the height $H_c$ of LED assembly 200 with respect to the height $H_u$ of LED assembly 200 in an uncompressed state. Referring back to FIG. 5, as engaging members 223 descend deeper down angled slot 310, the compression force generated by resilient ribs 263 increases. This compression force lowers the thermal impedance between LED assembly 200 and thermally-conductive housing 400. Engaging members 223 and angled slots 310 thus form a compression element.

Figure 9:
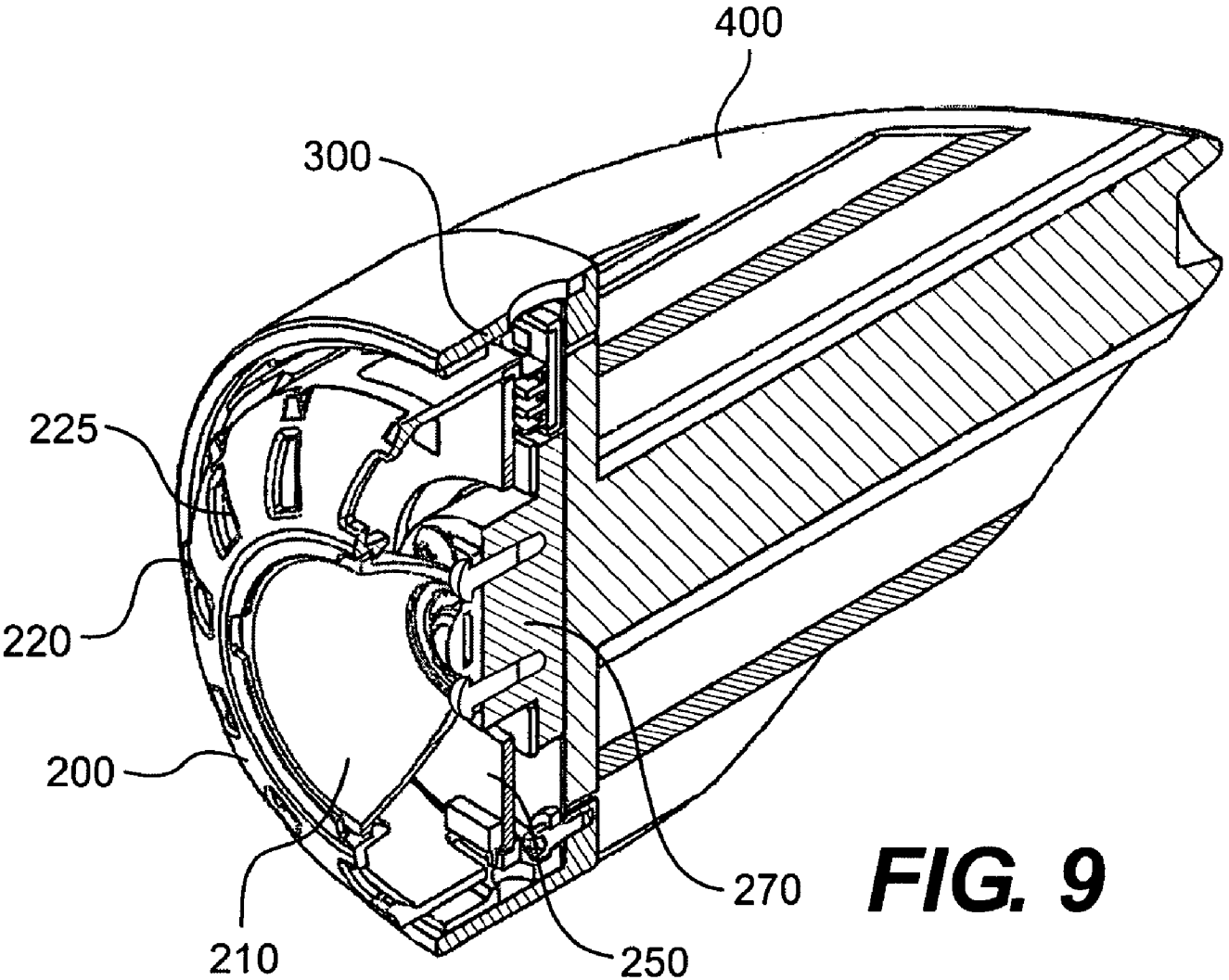
FIG. 9 is a perspective cross-sectional view of the light fixture assembly of FIG. 1.

FIG. 9 is a perspective cross-sectional view of an exemplary embodiment of a light fixture assembly showing LED assembly 200 in a compressed state such that it is thermally and electrically connected to thermally-conductive housing 400. As shown in FIG. 6B, if LED assembly 200 is removed from socket 300, resilient ribs 263 will return substantially to their initial undeformed state.

Figure 8B:
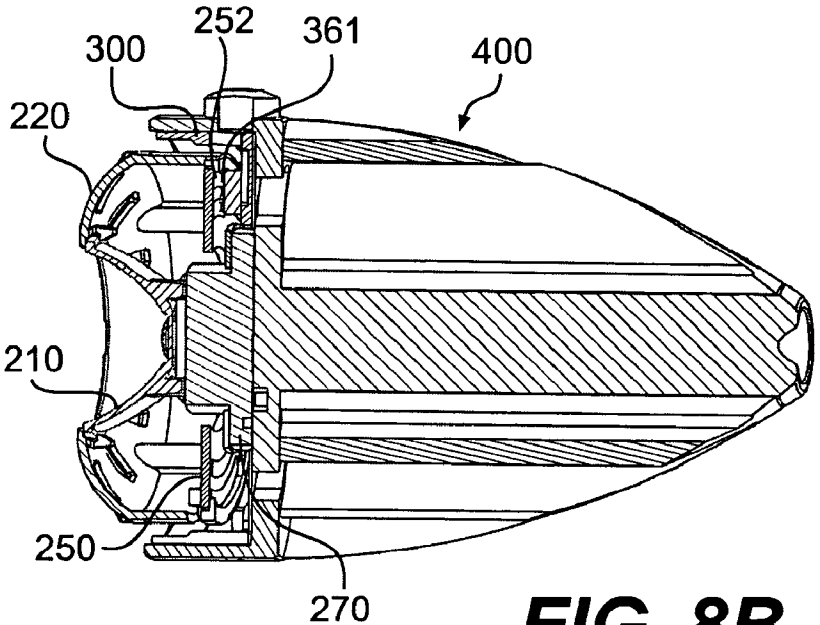
FIGS. 8A-8B are cross-sectional views of the light fixture assembly of FIG. 1.
Figure 8A:
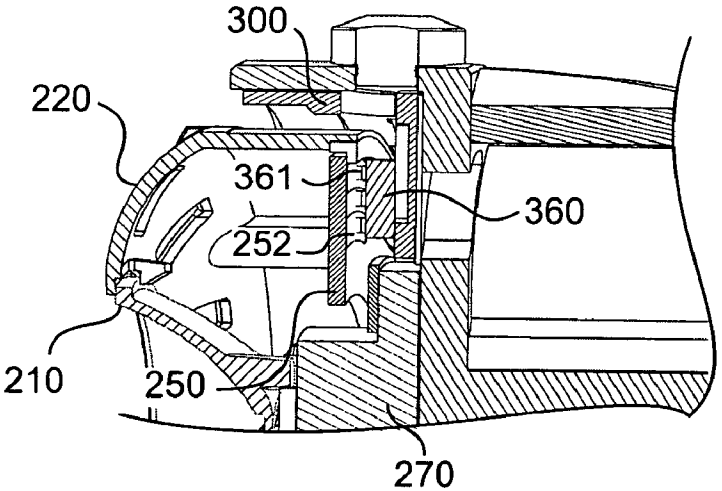

Additionally, as shown in FIGS. 8A and 8B, the rotation of LED assembly 200 forces printed circuit board electrical contact strips 252 on printed circuit board 250 into engagement with electrical contacts 361 of terminal block 360, thereby creating an electrical connection between LED assembly 200 and electrical contacts 361 of housing 400, so that operating power can be provided to LED 230. Alternate means may also be provided for supplying operating power to LED 230. For example, LED assembly 200 may include an electrical connector, such as a female connector for receiving a power cord from housing 400 or a spring-loaded electrical contact mounted to the LED assembly 200 or the housing 400.

As shown in FIG. 7, while in this embodiment receiving portions 311 of angled slots 310 are the same size, receiving portions 311, angled slots 310, and/or engaging members 223 may be of different sizes and/or shapes. For example, receiving portions 311 may be sized to accommodate a larger engaging member 223 so that LED assembly 200 may only be inserted into socket 300 in a specific position. Additionally, the location and number of angled slots 310 are not limited to the exemplary embodiment shown in FIG. 7.

Furthermore, while the above-described exemplary embodiment uses angled slots, other types of engagement between LED assembly 200 and LED socket 300 may be used to create thermal and electrical connections between LED assembly 200 and thermally-conductive housing 400.

Figure 11:
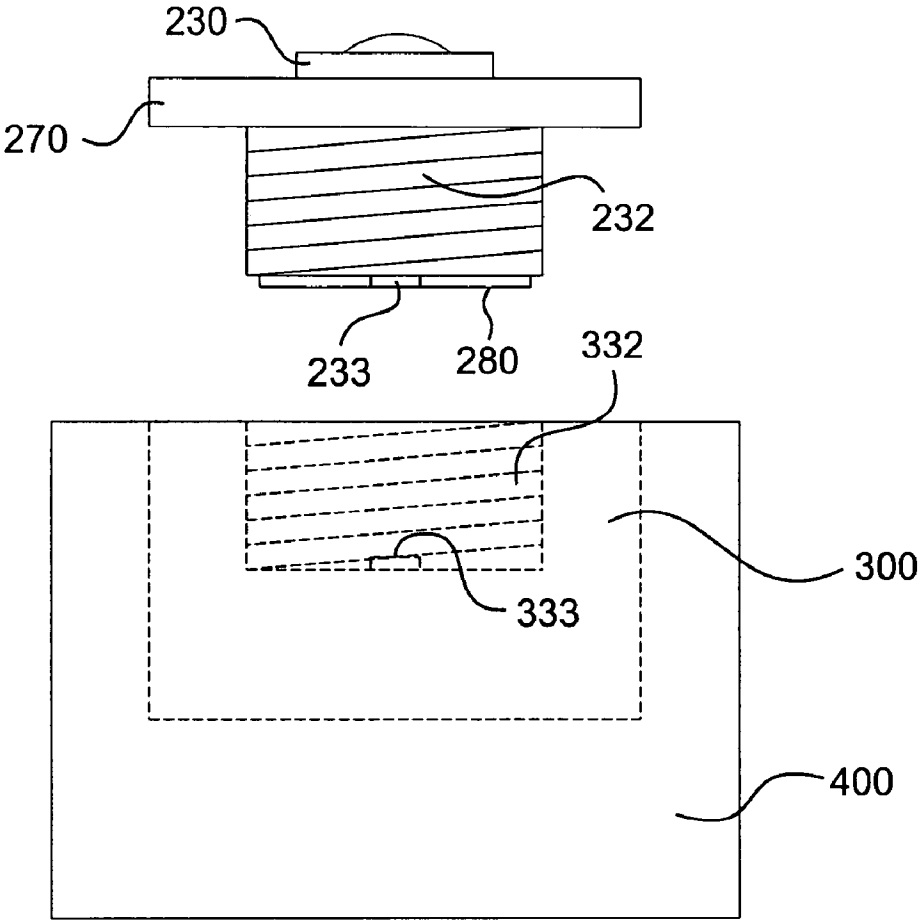
FIG. 11 is a front view of a light fixture assembly according to a second exemplary embodiment.

As shown in FIG. 11, in a second exemplary embodiment of a light fixture assembly, LED assembly 230 may be mounted to a thermal interface member 270, which may include a male threaded portion 232 with a first button-type electrical contact 233 insulated from threaded portion 232. Male threaded portion 232 of thermal interface member 270 could rotatably engage with, for example, a female threaded portion 332 of socket 300, such that one or both of male and female threaded portions 232, 332 slightly deform to create compressive force such that first electrical contact 233 comes into contact with second button-type electrical contact 333 and the thermal impedance between thermal interface member 270 and housing 400 is lowered. A thermal pad 280 with a circular center cut-out may be provided at an end portion of male threaded portion 232. The thermal pad 280 can have resilient features such that resilient thermal interface pad 280 acts as a spring to create or increase a compression force to lower the thermal impedance between thermal interface member 270 and housing 400. Male and female threaded portions 232, 332 thus form a compression element.

Figure 12:
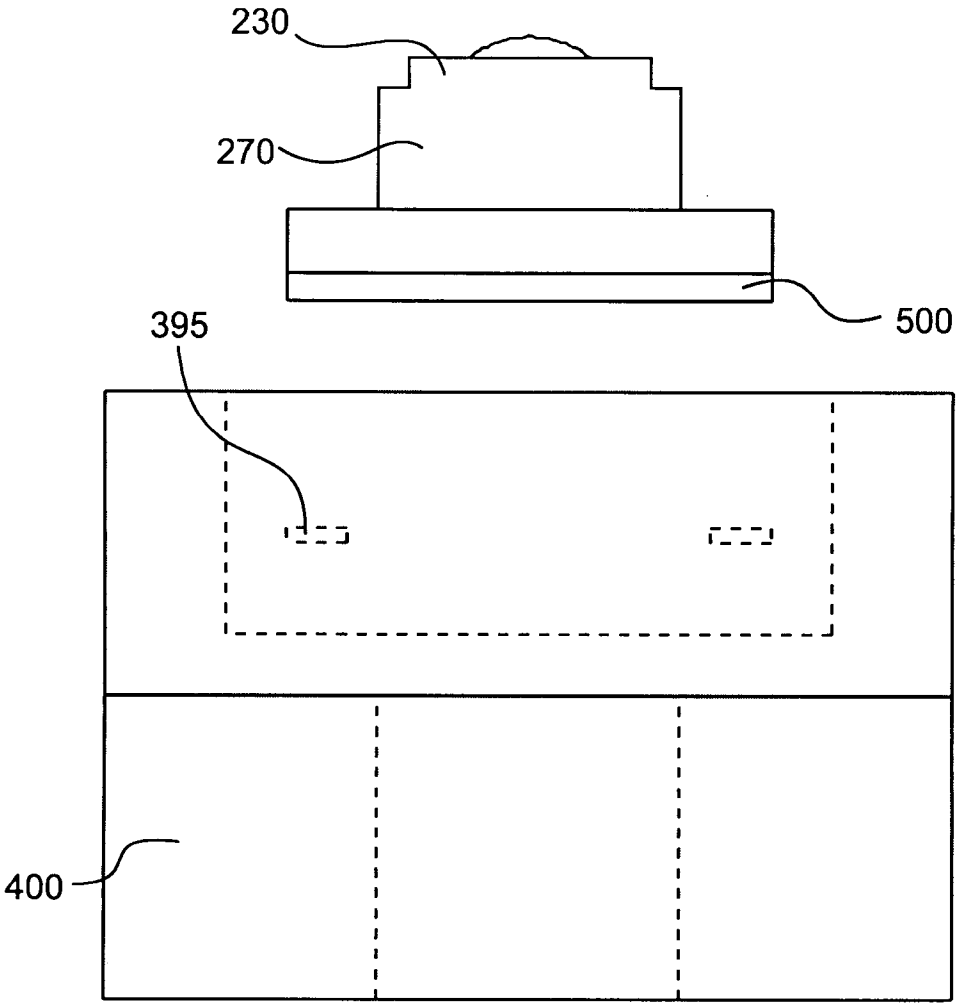
FIG. 12 is a front view of a light fixture assembly according to a third exemplary embodiment.

As shown in FIG. 12, in a third exemplary embodiment of a light fixture assembly, a resilient thermal interface pad 500 may be provided at an end portion of thermal interface member 270 such that resilient thermal interface pad 500 acts to create a compression force for low thermal impedance coupling. Socket 300 may include tabs 395 that engage with slots in thermal interface member 270 to form a compression element and create additional compression as well as to lock the LED assembly into place.

Figure 13:
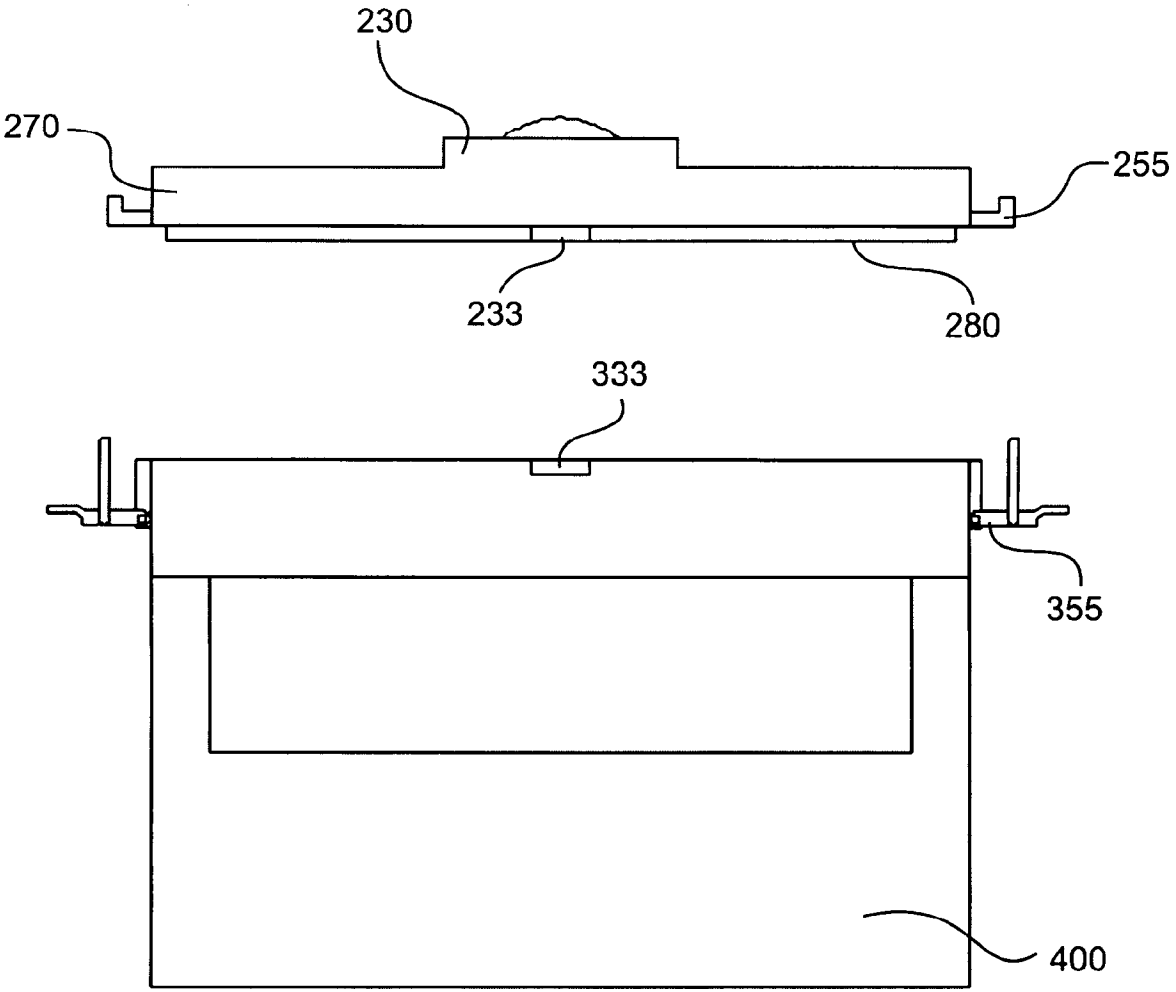
FIG. 13 is a front view of a light fixture assembly according to a fourth exemplary embodiment.
Figure 14:
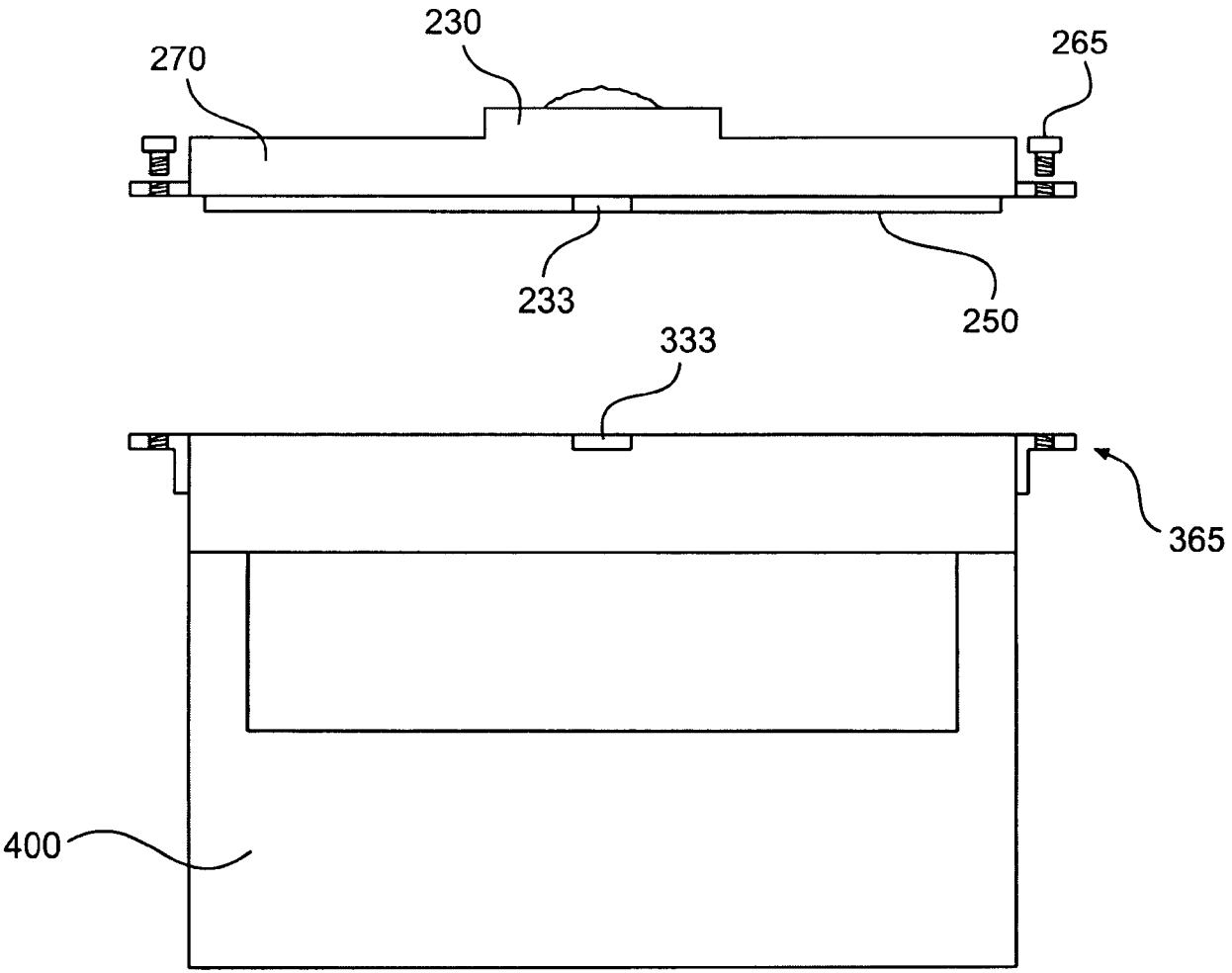
FIG. 14 is a front view of a light fixture assembly according to a fifth exemplary embodiment.

As shown in FIG. 13, in a fourth exemplary embodiment of a light fixture assembly, thermal interface member 270 may have a buckle catch 255 that engages with a buckle 355 on thermally-conductive housing 400, thus forming a compression element. As shown in FIG. 14, in a fifth exemplary embodiment of a light fixture assembly, a fastener such as screw 265 may attach to a portion 365 of heat-dissipating fixture housing 400 so as to form a compression element and create the appropriate compressive force to provide low impedance thermal coupling between thermal interface member 270 and thermally-conductive housing 400.

Referring back to FIG. 1, after LED assembly 200 is installed in thermally-conductive housing 400, a front cover 100 may be attached to socket 300 by engaging front cover engaging member 101 on the front cover 100 with front cover retaining mechanism 330, and rotating front cover 100 with respect to socket 300 to secure front cover 100 in place. Front cover 100 may include a main aperture 102 formed in a center portion of cover 100, a transparent member, such as a lens 104 formed in aperture 102, and a plurality of peripheral holes 106 formed on a periphery of front cover 100. Lens 104 allows light emitted from a lighting element to pass through cover 100, while also protecting the lighting element from the environment. Lens 102 may be made from any appropriate transparent material to allow light to flow therethrough, with minimal reflection or scattering.

As shown in FIG. 1, and consistent with the present invention, front cover 100, LED assembly 200, socket 300, and thermally-conductive housing 400 may be formed from materials having a thermal conductivity k of at least 12, and preferably at least 200, such as, for example, aluminum, copper, or thermally conductive plastic. Front cover 100, LED assembly 200, socket 300, and thermally-conductive housing 400 may be formed from the same material, or from different materials. Peripheral holes 106 may be formed on the periphery of front cover 100 such that they are equally spaced and expose portions along an entire periphery of the front cover 100. Although a plurality of peripheral holes 106 are illustrated, embodiments consistent with the present invention may use one or more peripheral holes 106 or none at all. Consistent with an embodiment of the present invention, peripheral holes 106 are designed to allow air to flow through front cover 100, into and around LED assembly 200 and flow through air holes in thermally-conductive housing 400 to dissipate heat.

Additionally, as shown in FIG. 1, peripheral holes 106 may be used to allow light emitted from LED 230 to pass through peripheral holes 106 to provide a corona lighting effect on front cover 100. Thermally-conductive housing 400 may be made from an extrusion including a plurality of surface-area increasing structures, such as ridges 402 (shown in FIG. 1) as described more completely in co-pending U.S. patent application Ser. No. 111715,071 assigned to the assignee of the present invention, the entire disclosure of which is hereby incorporated by reference in its entirety. Ridges 402 may serve multiple purposes. For example, ridges 402 may provide heat-dissipating surfaces so as to increase the overall surface area of thermally-conductive housing 400, providing a greater surface area for heat to dissipate to an ambient atmosphere over. That is, ridges 402 may allow thermally-conductive housing 400 to act as an effective heat sink for the light fixture assembly. Moreover, ridges 402 may also be formed into any of a variety of shapes and formations such that thermally-conductive housing 400 takes on an aesthetic quality. That is, ridges 402 may be formed such that thermally-conductive housing 400 is shaped into an ornamental extrusion having aesthetic appeal. However, thermally-conductive housing 400 may be formed into a plurality of other shapes, and thus function not only as a ornamental feature of the light fixture assembly, but also as a heat sink for cooling LED 230.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A lighting assembly, comprising:

a light fixture;

a light module comprising an LED lighting element and removably coupleable to the light fixture; and one or more resilient members configured to generate a compression force when the light module is removably coupled to the light fixture to thereby exert a generally axial force on at least a portion of the light module to resiliently maintain at least a portion of the light module in resilient contact with a surface of the light fixture or socket of the light fixture to thereby resiliently couple at least a portion of the light module to the light fixture or socket of the light fixture, wherein one or both of the light module and light fixture comprises one or more engaging members that extend from a surface thereof, and wherein one or both of the light module and the light fixture comprises one or more slots configured to removably receive the one or more engaging members therein when coupling the light module to the light fixture.

2. The lighting assembly of claim 1, wherein the light fixture comprises a socket, one or more of said slots defined on a surface of the socket.

3. The lighting assembly of claim 2, wherein the one or more slots in the socket have a surface at least a portion of which is generally inclined toward a bottom of the socket, one or more of the engaging members configured to engage said inclined surface as the light module is rotated relative to the socket during coupling of the light module to the socket such that the engagement between the engaging members and the inclined surface causes at least a portion of the light module to axially move toward the bottom of the socket as the light module is rotated relative to the socket.

4. The lighting assembly of claim 2, wherein the one or more slots are defined on an inner surface of the socket, said inner surface defining a cylindrical recess configured to removably receive at least a portion of the light module therein when coupling the light module to the socket.

5. The lighting assembly of claim 4, wherein the one or more slots in the socket have a generally horizontal surface between an end of the inclined surface and a generally vertical stop portion configured to prevent further rotation of the light module relative to the socket, the horizontal surface separated from the inclined surface by a protrusion, the one or more slots configured to hold the one or more engaging members in a releasably locked position when said one or more engaging members are disposed between the protrusion and the generally vertical stop portion.

6. The lighting assembly of claim 1, wherein the compression force axially drives at least a portion of the light module into resilient contact with a surface of the light fixture to thereby thermally couple the light module to the light fixture.

7. The lighting assembly of claim 1, wherein the one or more engaging members extend radially from a surface of the light module.

8. The lighting assembly of claim 1, wherein the one or more resilient members are disposed in the light module.

9. The lighting assembly of claim 2, wherein the light module comprises one or more electrical contact members configured to releasably contact one or more electrical contacts of the socket to provide an operative electrical connection between the light module and the socket when the light module is coupled to the socket.

10. The lighting assembly of claim 1, wherein the LED lighting element is disposed along a central axis of the light module.

11. The lighting assembly of claim 1, wherein the LED lighting element is rotationally fixed relative to the one or more engaging members, such that the LED lighting element rotates together with the one or more engaging members and the rest of the light module when the light module is rotated.

12. A light module removably coupleable to a light fixture, the light module comprising:

a generally cylindrical housing;

an LED lighting element at least partially disposed in the housing;

one or more electrical contact members configured to releasably contact one or more electrical contacts of a socket of a light fixture to provide an operative electrical connection between the light module and the socket of the light fixture when the light module is coupled to the light fixture; and one or more engaging members on the housing, the engaging members configured to releasably engage corresponding one or more engaging elements in the socket of the light fixture when coupling the light module to the socket, wherein the engagement of the engaging members with the engaging elements of the socket axially drives at least a portion of the light module into resilient contact with a surface of a light fixture or socket of the light fixture when coupling the light module to the socket to thereby thermally couple the light module to the light fixture or socket of the light fixture.

13. The light module of claim 12, wherein the one or more engaging members extend radially outward from a circumferential surface of the housing.

14. The light module of claim 12, wherein the LED lighting element is disposed along a central axis of the light module.

15. The light module of claim 12, wherein the LED lighting element is rotationally fixed relative to the housing and the one or more engaging members, such that the LED lighting element rotates together with the housing and the one or more engaging members when the light module is rotated.

16. The light module of claim 12, wherein the one or more engaging elements of the socket comprise one or more slots in a surface of the socket.

* * * * *